US005836100A

United States Patent [19]

Stover

[11] Patent Number: 5,836,100

[45] Date of Patent: Nov. 17, 1998

[54] FIBER OPTIC SIGHT

[75] Inventor: Gerald E. Stover, Lapeer, Mich.

[73] Assignee: Williams Gun Sight Co., Davison, Mich.

[21] Appl. No.: 677,520

[22] Filed: Jul. 10, 1996

[51] Int. Cl.[6] ..... F41G 1/34

[52] U.S. Cl. ..... 42/103; 42/100; 42/102

[58] Field of Search ..... 42/103, 100, 102; 89/1.61, 41.17; 358/901.1; 33/233, 241, 261

[56] References Cited

U.S. PATENT DOCUMENTS

| | | | |
|---|---|---|---|
| Re. 24,313 | 5/1957 | Munsey | 33/47 |
| D. 305,146 | 12/1989 | Novak . | |
| 2,822,616 | 2/1958 | Gangl | 33/52 |
| 3,098,303 | 7/1963 | Plisk | 33/241 |
| 3,568,323 | 3/1971 | Lendway | 33/46 |
| 3,579,839 | 5/1971 | Kowalski | 33/46 |
| 3,700,339 | 10/1972 | Steck, III | 356/247 |
| 3,813,790 | 6/1974 | Kaltmann | 33/241 |
| 3,822,479 | 7/1974 | Kowalski | 33/265 |
| 3,911,607 | 10/1975 | Luebkeman | 42/15 |
| 3,949,482 | 4/1976 | Ross | 33/241 |
| 3,961,423 | 6/1976 | Hrebar | 33/258 |
| 4,030,203 | 6/1977 | Ackerman, Jr. | 33/241 |
| 4,070,763 | 1/1978 | Carts, Jr. | 33/241 |
| 4,177,572 | 12/1979 | Hindes | 33/265 |
| 4,434,560 | 3/1984 | Comeyne | 33/241 |
| 4,495,705 | 1/1985 | Kowalski et al. | 33/265 |
| 4,620,372 | 11/1986 | Goodrich | 33/265 |
| 4,628,611 | 12/1986 | Ruffino | 33/254 |
| 4,651,432 | 3/1987 | Bornancini | 33/233 |
| 4,745,698 | 5/1988 | Schwulst | 42/100 |
| 4,819,611 | 4/1989 | Sappington | 124/87 |
| 4,877,324 | 10/1989 | Hauri et al. | 356/251 |
| 4,928,394 | 5/1990 | Sherman | 33/265 |
| 5,001,837 | 3/1991 | Bray | 33/265 |
| 5,065,519 | 11/1991 | Bindon | 33/241 |
| 5,094,002 | 3/1992 | Saunders | 33/265 |
| 5,101,589 | 4/1992 | Duncan | 42/71.02 |
| 5,103,713 | 4/1992 | Lovina | 87/1.816 |
| 5,121,462 | 6/1992 | Fabre et al. | 385/143 |
| 5,168,540 | 12/1992 | Winn et al. | 385/128 |
| 5,168,631 | 12/1992 | Sherman | 33/265 |
| 5,201,124 | 4/1993 | Sherman | 33/265 |
| 5,208,407 | 5/1993 | Stover | 42/102 |
| 5,231,765 | 8/1993 | Sherman | 33/241 |
| 5,442,861 | 8/1995 | Lorocco | 33/241 |
| 5,443,543 | 8/1995 | Epes et al. | 42/102 |

FOREIGN PATENT DOCUMENTS

| | | |
|---|---|---|
| 0470016 | 5/1992 | European Pat. Off. . |
| 4214997 | 11/1993 | Germany . |

*Primary Examiner*—Charles T. Jordan
*Assistant Examiner*—Meena Chelliah
*Attorney, Agent, or Firm*—Harness, Dickey & Pierce, PLC

[57] ABSTRACT

A sighting device in the form of a fiber optic front sight has a frame which mates with a vent rib of a weapon. The frame defines a hole which fits over a front bead sight on the shotgun. A locking screw threadingly received in an upstanding boss on the frame is turned such that the locking screw engages the bead sight to secure the sighting device to the shotgun. A fiber optic element is secured to the frame and the mating of the frame with the vent rib aligns the fiber optic element such that one end faces the stock end of the weapon. The fiber optic element absorbs available light and emits this light through the ends of the element. Another embodiment of the sighting device utilizes a bolt to secure the sighting device to the shotgun by threadingly engaging the threaded bore used to mount the front bead sight once the front bead sight has been removed. An additional embodiment utilizes a front sight with one fiber optic element and a rear sight with a pair of fiber optic elements. The front fiber optic element is viewable between the pair of rear fiber optic elements to aim the weapon.

13 Claims, 4 Drawing Sheets

FIG. 13.
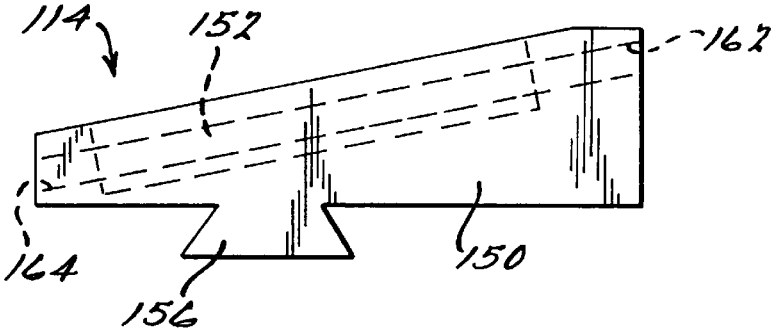
FIG. 14.
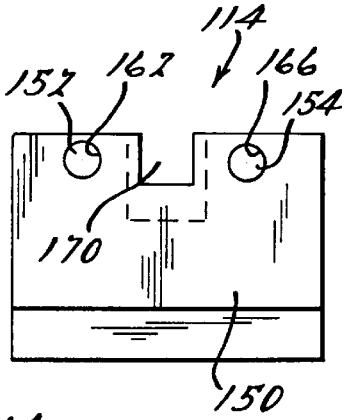
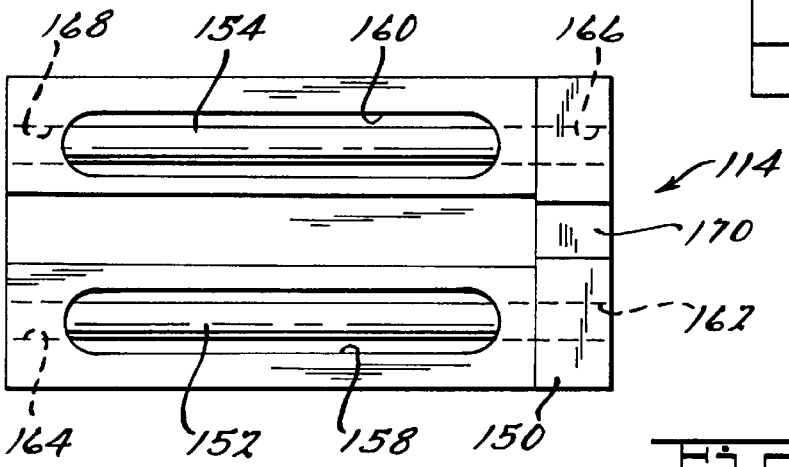
FIG. 15.
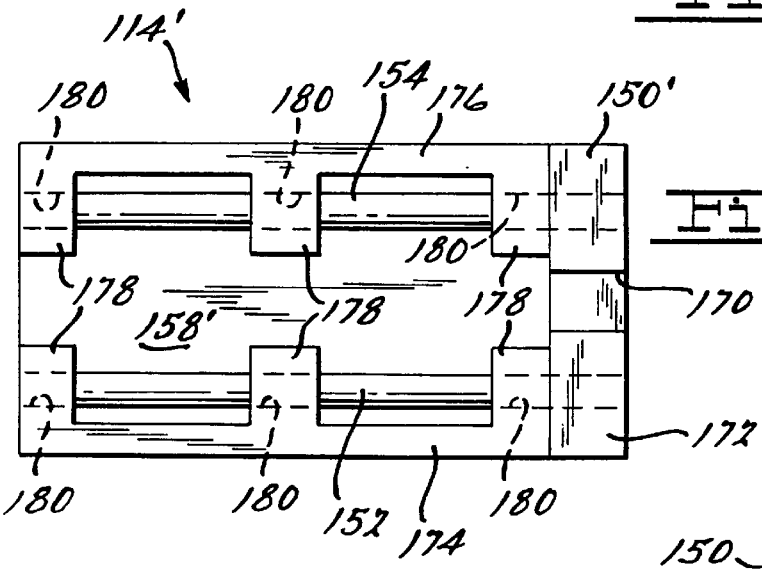
FIG. 17.
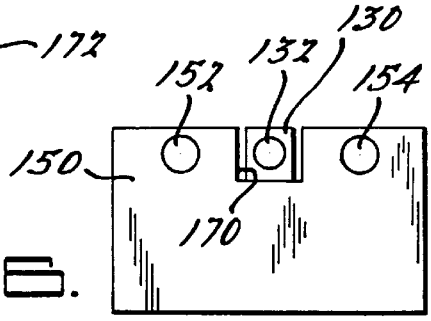
FIG. 16.

FIBER OPTIC SIGHT

FIELD OF THE INVENTION

The present invention relates to sights incorporating fiber optic elements. More particularly, the present invention relates to shotgun sights and pistol sights which incorporate fiber optic elements to improve the ability of aiming in low light situations.

BACKGROUND OF THE INVENTION

Prior art shotgun and pistol sights have been most commonly of the metal bead or bar types with the sectional diameter of the bead or bar being varied depending on the length of the barrel and the need to obtain maximum visibility for aiming. It is well known that in order to obtain maximum accuracy of aim, it is necessary to have a front sight bead as small in diameter as possible, but the bead must be large enough to be visible through the rear sight even under adverse light conditions. This results in a compromise in the diameter of the bead in order to accommodate the adverse light conditions experienced during normal hunting hours.

In low light conditions, as in the early morning or late afternoon, the sighting of a weapon on a target is rendered difficult by the reduced demarcation between the sight and the target. Illuminated sights are found in the prior art sights utilizing an artificial light source such as a battery illuminated bulb or diode or a capsule having a radio-active luminescent source such as tritium to increase the accuracy during these low light situations. The illuminating of the sights enables the utilization of a smaller diameter bead due to the increase in the demarcation between the sight and the target. The utilization of artificial power sources for hunting sights is now banned by several states, thus excluding these types of sights for universal application.

Optical sights which utilize a light collecting material of fluorescent light-transmitting material or the like have been developed to improve aiming during low light situations without the need for artificial or radio-active power sources. These sights absorb adequate amounts of ambient light and transmit this light to a bead of reduced size so that the associated sight structure does not interfere with the sight picture presented to the shooter.

The continued development of these optical sights utilizing a light collecting material are directed towards sights which are low in cost, easy to incorporate onto a weapon and those which provide the maximum amount of flexibility to the individual using the sight.

SUMMARY OF THE INVENTION

The present invention provides the art with a fiber optic shotgun and pistol sight which greatly improves the ability of aiming in low light conditions. Any availability of natural light will cause the fiber optic sight to glow brightly, making sight visibility much better than with conventional sights. The shotgun sight is adapted to attach to the vent rib of the shotgun by either tightening it against the existing shotgun bead sight or by removing the bead and attaching the sight using the existing screw hole. The pistol sights, both front and rear, are designed to mount directly to the pistol replacing the standard pistol sights.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention:

FIG. 13 is a side elevational view of the rear pistol sight shown in FIG. 9;

FIG. 14 is an end elevational view of the rear sight shown in FIGS. 9 and 13;

FIG. 15 is a top view of the rear sight shown in FIGS. 9, 14;

FIG. 16 is an end elevational view showing the pistol shooter's sight picture when the pistol sight shown in FIGS. 9 through 15 is being used; and FIG. 17 is a top view of a rear sight in accordance with another embodiment of the present invention.

DETAILED DESCRIPTION OF THE PREFERRED EMBODIMENT

Figure 1:
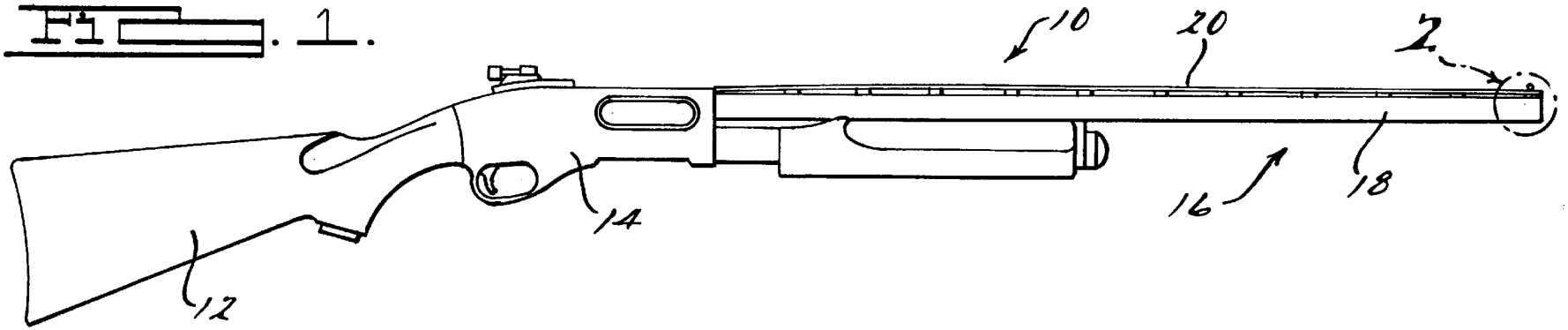
FIG. 1 is a side elevational view of a shotgun incorporating a front bead sight which can be superseded by a fiber optic sight in accordance with the present invention.

Referring now to the drawings in which like reference numerals designate like or corresponding parts throughout the several views, there is shown in FIG. 1 a typical weapon which is identified by the reference numeral 10. Weapon 10 comprises a stock 12, a receiver assembly 14, and a barrel assembly 16. Stock 12 is assembled to receiver assembly 14 and barrel assembly 16 is assembled to both stock 12 and receiver assembly 14. Barrel assembly 16 comprises a barrel 18 and a rib element 20 which extends over generally the entire length of barrel 18.

Figure 2:
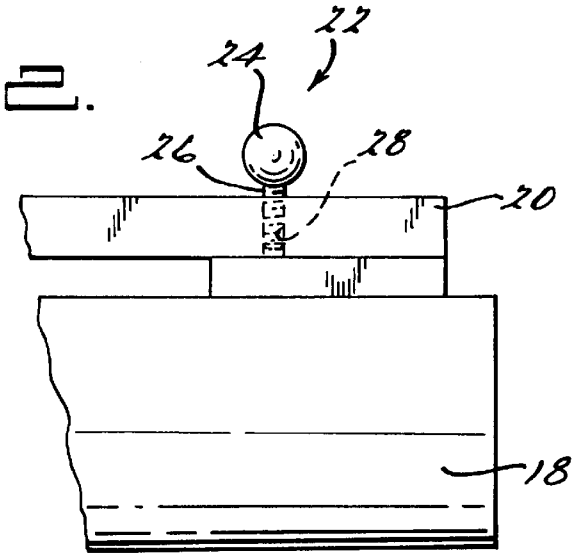
FIG. 2 is an enlarged view, partially in cross-section, of the end of the barrel of the shotgun shown in FIG. 1 showing the details of the front bead sight.
Figure 3:
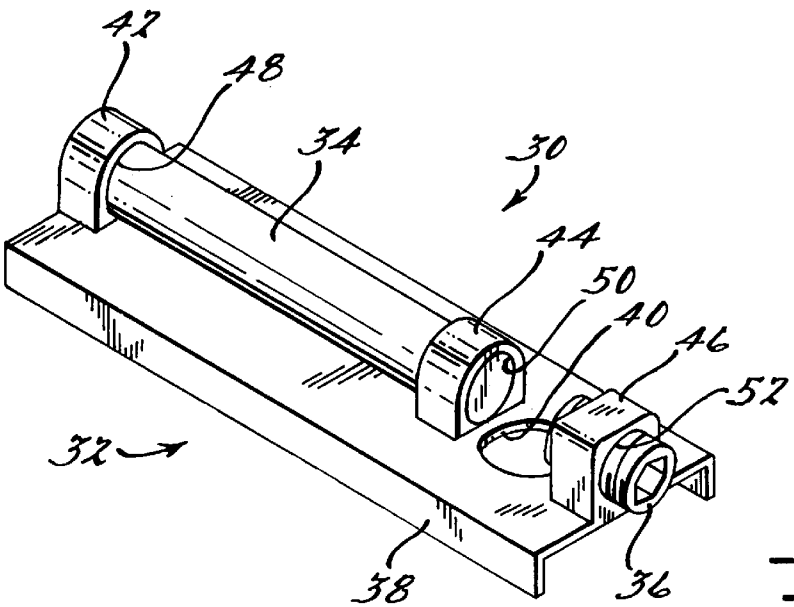
FIG. 3 is a perspective view of the fiber optic sight in accordance with the present invention.
Figure 4:
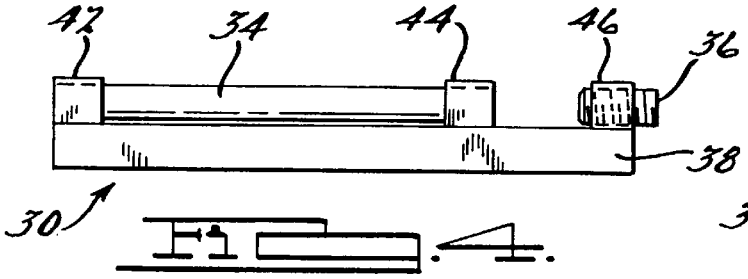
FIG. 4 is a side elevational view of the fiber optic sight shown in FIG. 3.
Figure 5:
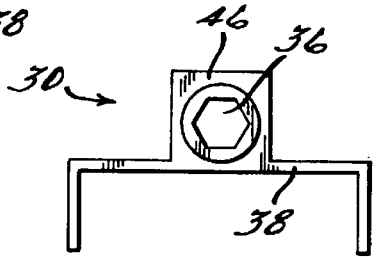
FIG. 5 is an end elevational view of the fiber optic sight shown in FIGS. 3 and 4.
Figure 6:
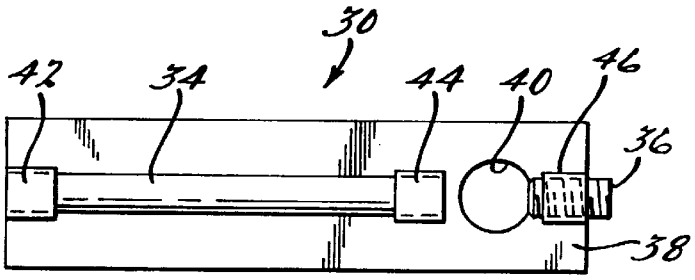
FIG. 6 is a plan elevational view of the fiber optic sight shown in FIGS. 3 through 5.

Referring now to FIG. 2, rib element 20 includes a front bead sight 22 which is comprised of a generally spherical bead 24 and a threaded portion 26. Threaded portion 26 is threadingly received into a threaded bore 28 extending into rib element 20. For exemplary purposes, weapon 10 is illustrated as a shotgun. It should be understood that the present invention can be utilized with any weapon which utilizes front bead sight 22.

Referring now to FIGS. 3 through 6, a sighting device in the form of a fiber optic sight 30 is illustrated. Fiber optic sight 30 comprises an attaching base 32, a fiber optic element 34 and a locking screw 36. Base 32 includes a generally U-shaped frame 38 defining a through hole 40 located at one end of frame 38. Frame 38 has a pair of upstanding brackets 42 and 44 extending from frame 38 and a single upstanding boss 46 which extends from frame 38 in the same general direction as brackets 42 and 44 at a position adjacent to and outbound of through hole 40. Fiber optic element 34 extends between brackets 42 and 44 and is located within a pair of apertures 48 and 50 extending through brackets 42 and 44, respectively. Fiber optic element 34 is securely held within apertures 48 and 50 by gluing or other means known well in the art, with movement of fiber optic element 34 with respect to base 32 being prohibited. Locking screw 36 is threadingly received within a threaded aperture 52 extending through boss 46 to provide for the assembly of fiber optic sight 30 to weapon 10 as will be described later herein.

Figure 7:
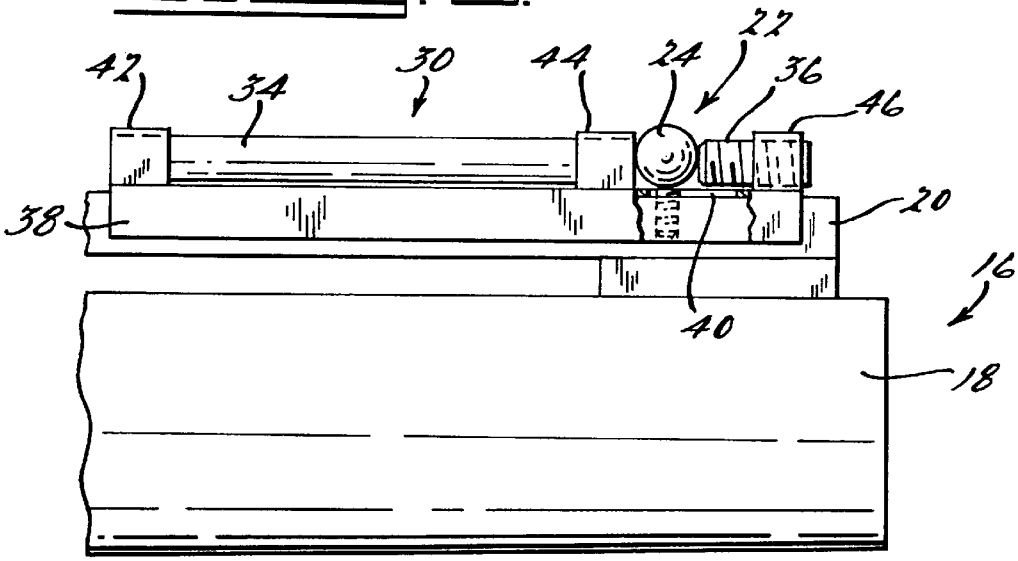
FIG. 7 is an enlarged view similar to FIG. 2, but showing the assembly of the fiber optic sight in accordance with the present invention to the front bead sight.

Referring now to FIG. 7, fiber optic sight 30 is shown assembled to front bead sight 22 of barrel assembly 16. Fiber optic sight 30 is placed over front bead sight 22 with bead 24 extending through hole 40. The U-shaped configuration of frame 38 is designed to fit over rib element 20 such that the legs of U-shaped frame 38 extend down along the sides of rib element 20 to guide and position fiber optic sight 30 longitudinally along rib element 20 such that one end of fiber optic element 34 faces the stock end of weapon 10. Locking screw 36 is then tightened against bead 24 to secure fiber optic sight 30 to barrel assembly 16. This simplified assembly for fiber optic sight 30 allows it to be assembled to weapon 10 when low lighting conditions exist and then easily removed to return to the normal bead sight 22 when lighting conditions improve.

Figure 8:
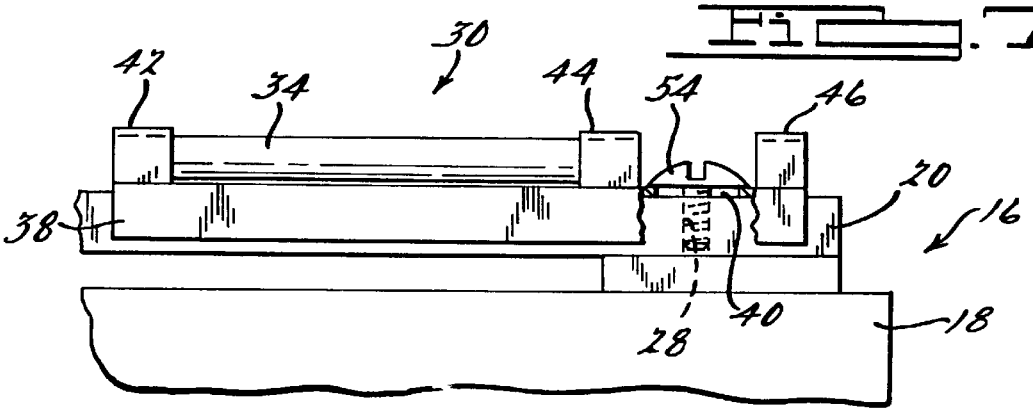
FIG. 8 is an enlarged view similar to FIG. 2, but showing the replacement of the front bead sight with the fiber optic sight in accordance with the present invention.

Referring now to FIG. 8, fiber optic sight 30 is shown assembled to barrel assembly 16 by replacing bead sight 22 rather than being assembled to bead sight 22. Bead sight 22 is first removed from barrel assembly 18 by unscrewing threaded portion 26 from bore 28 of rib element 20. Fiber optic sight 30 is placed on rib element 20 with hole 40 being aligned with threaded bore 28. The U-shaped configuration of frame 38 is designed to fit over rib element 20 such that the legs of U-shaped frame 38 extend down along the sides of rib element 20 to guide and position fiber optic sight 30 longitudinally along rib element 20 such that one end of fiber optic element 34 faces the stock end of weapon 10. A bolt 54 is then inserted through hole 40 and threaded into bore 28 and then tightened to secure fiber optic sight 30 to rib element 20. If necessary, a washer can be placed between bolt 54 and frame 38 to facilitate the assembly of fiber optic sight 30 to barrel assembly 16. When fiber optic sight is used to replace bead sight 22, fiber optic sight 30 can include a frame 38 which does not have boss 46. This would eliminate the option of mounting sight 30 to bead sight 22 and limit the sight to replacing bead sight 22.

Fiber optic element 34 is preferably an Optibright™ scintillating fiber manufactured by Poly-Optical® Products Inc. of Irvine, Calif. Optibright™ scintillating fibers consist of a polystyrene-based core and a polymethyl methacrylate (PMMA) cladding. Cladding thickness is approximately 3% of the fiber diameter. The core contains a combination of fluorescent dopants selected to produce the desired scintillation, optical and radiation detection characteristics. Fluorescent fibers "collect" or absorb light from their surroundings, conducting it within the material and emitting a large portion of it in a concentrated form at both ends. As can be seen in FIGS. 3 through 6, brackets 42 and 44 of frame 38 which secure fiber optic element 34 to frame 38 are made as narrow as possible in order to expose a maximum length of fiber optic element 34 to the available ambient light. This provides for the maximum amount of "collection" or absorption of light by fiber optic element 34 and the subsequent emitting of this collected light through the ends of element 34. This allows fiber optic sight 30 to significantly improve the aiming ability of an individual using weapon 10 in low light situations.

Figure 9:
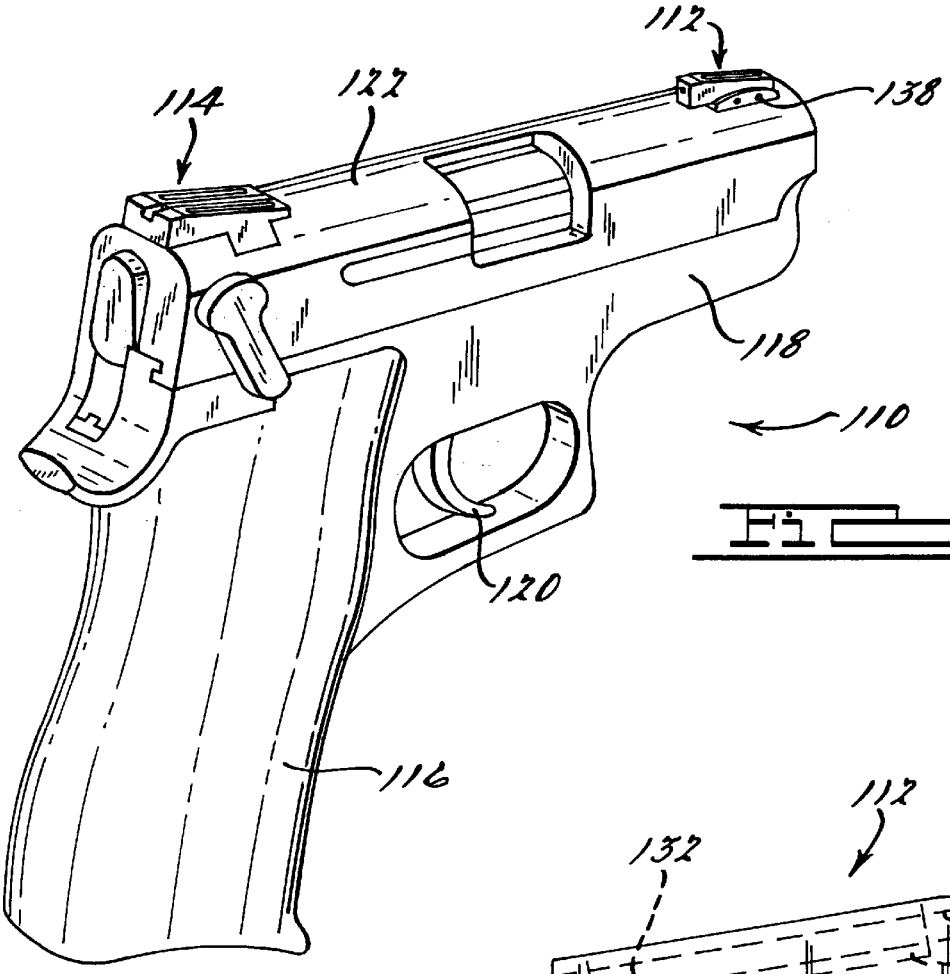
FIG. 9 is a perspective view of a pistol incorporating a fiber optic sight in accordance with another embodiment of the invention.

Referring now to FIG. 9, a typical handgun or pistol 110 is shown having aiming sights including a front sight 112 and a rear sight 114. Pistol 110 includes a handle 116, a lower receiver 118, a typical trigger mechanism 120 and a slide 122 slidably supported on lower receiver 118. The details and operation of pistol 110 are well known and do not constitute a part of the present invention and thus will not be discussed further herein.

Referring now to FIGS. 9–12, front sight 112 is mounted at the front of slide 122. Front sight 112 comprises a housing 130 and a fiber optic element 132. Housing 130 is adapted for mounting to slide 122 using a protrusion 134 which defines a pair of holes 136. Holes 136 mate with a corresponding set of apertures 138 located on slide 122 to fixably mount front sight 112 to pistol 110 using roll pins as is well known in the art. Housing 130 defines a cavity 138 and a pair of aligned apertures 140 and 142 each of which enter one end of housing 130 to intersect with cavity 138. Fiber optic element 132 extends the entire length of housing 130 and is disposed within aperture 140, cavity 138 and aperture 142. Fiber optic element 132 is retained within housing 130 by gluing or other methods known well in the art. The portion of fiber optic element 132 which extends through cavity 138 is thus exposed to the ambient lighting conditions in the surrounding environment, thus enhancing its absorption of light.

Fiber optic element 132 is preferably an Optibright™ scintillating fiber manufactured by Poly-Optical® Products Inc. of Irvine, Calif. Optibright™ scintillating fibers consist of a polystyrene-based core and a polymethyl methacrylate (PMMA) cladding. Cladding thickness is approximately 3% of the fiber diameter. The core contains a combination of fluorescent dopants selected to produce the desired scintillation, optical and radiation detection characteristics. Fluorescent fibers "collect" or absorb light from their surroundings, conducting it within the material and emitting a large portion of it in a concentrated form at both ends.

Figure 10:
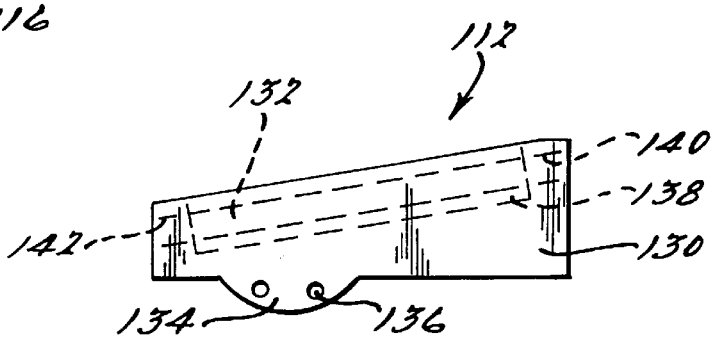
FIG. 10 is a side elevational view of the front pistol sight shown in FIG. 9.
Figure 11:
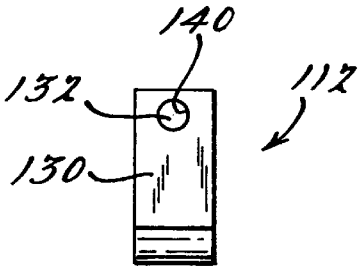
FIG. 11 is an end elevational view of the front pistol sight shown in FIGS. 9 and 10.
Figure 12:
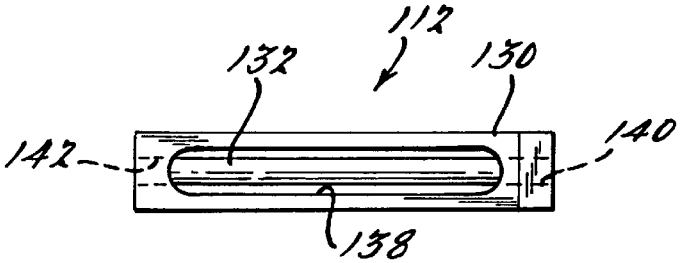
FIG. 12 is a top view of the front pistol sight shown in FIGS. 9 through 11.

As can be seen in FIGS. 10 through 12, cavity 138 of housing 130 is made as long as possible in order to expose a maximum length of fiber optic element 132 to the available light while still leaving sufficient material to define apertures 140 and 142 to provide support for fiber optic element 132. This provides for the maximum amount of "collection" or absorption of light by fiber optic element 132 and the subsequent emitting of this collected light through the ends of element 132. This allows fiber optic element 132 to significantly improve the aiming ability of an individual using pistol 110 in low light situations.

Referring now to FIGS. 13 through 15, rear sight 114 is mounted at the rear of slide 122. Rear sight 114 comprises a housing 150 and a pair of fiber optic elements 152 and 154. Housing 150 is adapted for mounting to slide 122 using a dovetailed protrusion 156. Protrusion 156 mates with a corresponding dovetailed slot in slide 122 to mount rear sight 114 as is well known in the art. Housing 150 defines a pair of cavities 158 and 160 and two pairs of aligned apertures 162, 164 and 166, 168. Apertures 162 and 164 intersect with cavity 158 and apertures 166 and 168 intersect with cavity 160. Apertures 162, 164 and cavity 158 are located on one side of housing 150 and apertures 166, 168 and cavity 160 are located on the opposite side of housing 150. Fiber optic element 152 extends the entire length of housing 150 and is disposed within aperture 162, cavity 158 and aperture 164. Fiber optic element 154 extends the entire length of housing 150 generally parallel to element 152 and is disposed within aperture 166, cavity 160 and aperture 168. Fiber optic elements 152 and 154 are retained within housing 150 by gluing or other methods known well in the art. The portion of fiber optic element 152 which extends through cavity 158 and the portion of fiber optic element 154 which extends through cavity 160 are thus exposed to the ambient lighting conditions in the surrounding environment and thus enhancing their absorption of light.

Fiber optic element 152 and 154 are preferably an Optibright™ scintillating fiber manufactured by Poly-Optical® Products Inc. of Irvine, Calif. Optibright™ scintillating fibers consist of a polystyrene-based core and a polymethyl methacrylate (PMMA) cladding. Cladding thickness is approximately 3% of the fiber diameter. The core contains a combination of fluorescent dopants selected to produce the desired scintillation, optical and radiation detection characteristics. Fluorescent fibers "collect" or absorb light from their surroundings, conducting it within the material and emitting a large portion of it in a concentrated form at both ends.

As can be seen in FIGS. 13 through 15, cavities 158 and 160 of housing 150 are made as long as possible in order to expose a maximum length of fiber optic elements 152 and 154, respectively, to the available light while still leaving sufficient material to define apertures 162, 164 and 166, 168, respectively, to provide support for fiber optic elements 152 and 154, respectively. This provides for the maximum amount of "collection" or absorption of light by fiber optic elements 152 and 154 and the subsequent emitting of this collected light through the ends of elements 152 and 154. This allows fiber optic elements 152 and 154 to significantly improve the aiming ability of an individual using pistol 110 in low light situations.

Housing 150 defines a slot 170 which extends the length of housing 150 between cavities 158 and 160 and thus between fiber optic elements 152 and 154. Slot 170 is utilized for viewing front sight 112 during aiming of pistol 110 as is shown in FIG. 16 which is the shooter's sight picture when aiming the weapon. When aiming pistol 110, pistol 110 is moved until front sight 112 is viewable through slot 170 of rear sight 114. This places the trajectory of the bullet fired by pistol 110 in line with the target. Fiber optic elements 132, 152 and 154 aid in the aiming of pistol 110 in low light conditions by providing circles of light which can be aligned. As shown in FIG. 16, when the circle of light emitted by fiber optic element 132 of front sight 112 is viewable between the circles of light emitted by fiber optic elements 152 and 154 of rear sight 114, front sight 112 is positioned within slot 170 of rear sight 114 and the trajectory of the bullet fired by pistol 110 is in line with the target.

FIG. 17 illustrates another embodiment of the rear sight for pistol 110 and it is designated by reference numeral 114'. Rear sight 114' is similar to rear sight 114 except that housing 150 of rear sight 114 is replaced by housing 150'. Housing 150' defines one large cavity 158' which is defined by a front wall 172 and a pair of opposing side walls 174 and 176. Side walls 174 and 176 are angled in the side view similar to housing 150 as shown in FIG. 13. In addition, housing 150' includes a dovetailed protrusion (not shown) for mounting of rear sight 114' to pistol 110. Each side wall 174 and 176 defines a plurality of fingers 178 which extend towards the center of housing 150' to provide support for fiber optic elements 152 and 154 such that they are substantially open to ambient light. Each finger 178 is provided with an aperture 180 through which fiber optic elements 152 and 154 extend as shown in FIG. 17. The operation and function of rear sight 114' is the same as rear sight 114 with front sight 112 being positioned within slot 170 for aiming pistol 110. Thus, the shooter's sight picture shown in FIG. 16 is the same for rear sight 114'.

While the above detailed description describes the preferred embodiment of the present invention, it should be understood that the present invention is susceptible to modification, variation and alteration without deviating from the scope and fair meaning of the subjoined claims.

What is claimed is:

1. A sighting device for a weapon having a barrel assembly which includes a front bead sight threadingly received within a threaded bore extending into said barrel assembly, said sighting device comprising:

a generally U-shaped frame defining a hole for securing said sighting device to said barrel assembly and a pair of legs for guiding and positioning said frame on said barrel assembly;

a fiber optic element;

means for securing said fiber optic element to said frame, said securing means extending from said frame and positioned to substantially surround a portion of the periphery of said fiber optic element to secure said fiber optic element to said frame and a portion of said fiber optic element uncovered by said securing means enabling enhanced absorption of light by said fiber optic element; and means for securing said sighting device to said barrel assembly, said securing means utilizing said hole for securing said sighting device to said barrel assembly.

2. The sighting device according to claim 1 wherein said securing means includes a bolt extending through said hole in said frame and threadingly received within said threaded bore.

3. The sighting device according to claim 1 wherein said securing means includes a boss extending from said frame and a locking screw threading received within a threaded aperture in said boss, said locking screw engaging said front bead sight to secure said sighting device to said barrel assembly.

4. The sighting device according to claim 1 wherein said frame includes a first and a second upstanding bracket for engagement with said fiber optic element.

5. The sighting device according to claim 4 wherein said securing means includes a bolt extending through said hole in said frame and threadingly received within said threaded bore.

6. The sighting device according to claim 4 wherein said securing means includes a boss extending from said frame and a locking screw threading received within a threaded aperture in said boss, said locking screw engaging said front bead sight to secure said sighting device to said barrel assembly.

7. A sighting device for a weapon having a barrel assembly which includes a front bead sight, said sighting device comprising:

a frame having an upstanding boss disposed at one end, said boss defining a threaded aperture, said frame defining a hole disposed adjacent to said upstanding boss;

a fiber optic element secured to said frame, said fiber optic element extending between said hole and the other end of said frame; and a locking screw threadingly received within said threaded aperture, said locking screw engaging said bead sight to secure said sighting device to said barrel assembly.

8. The sighting device according to claim 7 wherein said frame includes a first and a second upstanding bracket for engagement with said fiber optic element.

9. A sighting device for a weapon having a barrel, said sighting device comprising:

a front sight disposed adjacent to one end of said barrel, said front sight comprising a front housing attached adjacent to said one end of said barrel and a fiber optic element secured to said front housing; and a rear sight disposed adjacent to the opposite end of said barrel, said rear sight comprising a rear housing including a mechanism for attaching said rear housing adjacent to said opposite end of said barrel and a pair of fiber optic elements housed within said rear housing, said pair of fiber optic elements being spaced from one another to define a slot, said fiber optic element of said front sight being viewable through said slot and between said pair of fiber optic elements of said rear sight for aiming said weapon, said rear housing defining at least one cavity and a plurality of fingers extending into said cavity, at least one of said pair of fiber optic elements of said rear sight being supported by a portion of said fingers such that said at least one of said pair of fiber optic elements is substantially open to ambient light to enhance absorption of light.

10. The sighting device according to claim 9 wherein said front housing defines an open cavity, said fiber optic element of said front sight extending through said open cavity to enhance absorption of light.

11. The sighting device according to claim 10 wherein said rear housing defines a pair of cavities and a plurality of fingers extending into each of said cavities, a respective fiber optic element of said rear sight being supported by a portion of said fingers of one of said pair of cavities such that said respective fiber optic element is substantially open to ambient light to enhance absorption of light.

12. The sighting device according to claim 9 wherein said rear housing defines a pair of cavities and a plurality of fingers extending into each of said cavities, a respective fiber optic element of said rear sight being supported by a portion of said fingers of one of said pair of cavities such that said respective fiber optic element is substantially open to ambient light to enhance absorption of light.

13. The sighting device according to claim 9 wherein each of said pair of fiber optic elements of said rear sight are supported by a portion of said fingers such that said pair of fiber optic elements are substantially open to ambient light to enhance absorption of light.

* * * * *

UNITED STATES PATENT AND TRADEMARK OFFICE

CERTIFICATE OF CORRECTION

PATENT NO. : 5,836,100

DATED : November 17, 1998

INVENTOR(S) : Gerald E. Stover

It is certified that error appears in the above-identified patent and that said Letters Patent is hereby corrected as shown below:

Title Page, [54] Title, after "OPTIC" insert --GUN--

Title Page, [57] Abstract, line 9, delete "aligns" & substitute --aligning-- therefor Col. 1, line 1, in Title after "OPTIC" insert --GUN--

Col. 2, line 8, delete "invention." & substitute --invention;-- therefor

Col. 6, line 44, claim 3, delete "threading" & substitute --threadingly-- therefor Col. 6, line 57, claim 6, delete "threading" & substitute --threadingly-- therefor Signed and Sealed this Twenty-fifth Day of May, 1999

*Attest:*

Q. TODD DICKINSON

*Attesting Officer*

*Acting Commissioner of Patents and Trademarks*